US005937945A

United States Patent [19]

Bussear et al.

[11] Patent Number: 5,937,945

[45] Date of Patent: Aug. 17, 1999

[54] COMPUTER CONTROLLED GAS LIFT SYSTEM

[75] Inventors: Terry R. Bussear, Friendswood, Tex.; Bruce E. Weightman, Skene, United Kingdom

[73] Assignee: Baker Hughes Incorporated, Houston, Tex.

[21] Appl. No.: 09/137,167

[22] Filed: Aug. 20, 1998

Related U.S. Application Data

[60] Division of application No. 08/812,467, Mar. 6, 1997, Pat. No. 5,896,924, which is a continuation-in-part of application No. 08/599,324, Feb. 9, 1996, Pat. No. 5,706,892, which is a continuation-in-part of application No. 08/386,505, Feb. 9, 1995, abandoned.

[51] Int. Cl.[6] ..... E21B 43/00

[52] U.S. Cl. ..... 166/250.15; 166/53; 166/372; 166/374

[58] Field of Search ..... 166/53, 65.1, 66, 166/72, 113, 250.15, 373, 372, 374

[56] References Cited

U.S. PATENT DOCUMENTS

| | | |
|---|---|---|
| Re. 32,463 | 7/1987 | Westlake et al. . |
| Re. 33,690 | 9/1991 | Adams. Jr. et al. . |
| Re. 34,111 | 10/1992 | Wynn . |
| 2,278,532 | 4/1942 | Crickmer . |
| 2,307,171 | 1/1943 | Tutton . |
| 2,803,197 | 8/1957 | Wiley et al. . |
| 3,219,107 | 11/1965 | Brown, Jr. et al. . |
| 3,357,490 | 12/1967 | Holmes . |
| 3,665,955 | 5/1972 | Conner . |
| 3,731,742 | 5/1973 | Sizer et al. . |
| 3,888,273 | 6/1975 | Douglas . |
| 3,958,633 | 5/1976 | Britch et al. . |
| 4,105,279 | 8/1978 | Glotin et al. . |
| 4,111,608 | 9/1978 | Elliott et al. . |
| 4,125,163 | 11/1978 | Fitzpatrick . |
| 4,150,721 | 4/1979 | Norwood . |
| 4,256,284 | 3/1981 | Balhouse . |
| 4,295,795 | 10/1981 | Gass et al. . |
| 4,337,653 | 7/1982 | Chauffe . |
| 4,367,794 | 1/1983 | Bednar et al. . |
| 4,413,676 | 11/1983 | Kervin . |
| 4,574,883 | 3/1986 | Carroll et al. . |
| 4,581,613 | 4/1986 | Ward et al. . |
| 4,616,700 | 10/1986 | Wood et al. . |
| 4,622,635 | 11/1986 | Chandra et al. . |
| 4,633,954 | 1/1987 | Dixon et al. . |
| 4,636,934 | 1/1987 | Schwendemann et al. . |
| 4,649,993 | 3/1987 | Going . |
| 4,664,602 | 5/1987 | Gordon . |
| 4,685,522 | 8/1987 | Dixon et al. . |
| 4,712,613 | 12/1987 | Nieuwstad . |
| 4,738,313 | 4/1988 | McKee . |
| 4,744,415 | 5/1988 | Crawford et al. . |
| 4,757,314 | 7/1988 | Aubin et al. . |
| 4,765,403 | 8/1988 | Crawford et al. . |
| 4,788,545 | 11/1988 | Farque . |

(List continued on next page.)

FOREIGN PATENT DOCUMENTS

| | | |
|---|---|---|
| 0 539 240 A2 | 4/1993 | European Pat. Off. . |
| 0 539 240 A3 | 4/1993 | European Pat. Off. . |
| 0 593 122 A2 | 4/1994 | European Pat. Off. . |
| 0 593 122 A3 | 4/1994 | European Pat. Off. . |
| 0 678 880 A1 | 10/1995 | European Pat. Off. . |
| 2 707 334 | 7/1993 | France . |
| WO 80/01187 | 6/1980 | WIPO . |
| WO 96/24745 | 8/1996 | WIPO . |

OTHER PUBLICATIONS

Contact Dataline Petroleum Services, Inc., When it comes to gas lift. . . SSC Mandrel turns the industry upside down. 4 pages.

*Primary Examiner*—Roger Schoeppel
*Attorney, Agent, or Firm*—Cantor Colburn LLP

[57] ABSTRACT

Computer control and sensory information are combined with gas lift valve having a plurality of individual openings which are openable or closeable individually to provide varying flow rates of the lift gas. Each of the openings is controlled and is sensitive to downhole sensors.

9 Claims, 7 Drawing Sheets

U.S. PATENT DOCUMENTS 4,796,699 1/1989 Upchurch .
4,846,269 7/1989 Schwatzmeyer .
4,856,595 8/1989 Upchurch .
4,865,125 9/1989 De Cuir .
4,886,126 12/1989 Yates, Jr. .
4,896,722 1/1990 Upchurch .
4,915,168 4/1990 Upchurch .
4,921,048 5/1990 Crow et al. .
4,922,423 5/1990 Koomey et al. .
4,971,160 11/1990 Upchurch .
4,976,314 12/1990 Crawford et al. .
4,989,671 2/1991 Lamp .
5,042,584 8/1991 Terral .
5,050,675 9/1991 Upchurch .
5,058,670 10/1991 Crawford et al. .
5,127,477 7/1992 Schultz .
5,132,904 7/1992 Lamp .
5,147,559 9/1992 Brophey et al. .
5,172,717 12/1992 Boyle et al. .
5,176,164 1/1993 Boyle .
5,188,183 2/1993 Hopmann et al. .
5,191,937 3/1993 Cook, Sr. .
5,226,494 7/1993 Rubbo et al. .
5,234,057 8/1993 Schultz et al. .
5,265,677 11/1993 Schultz .
5,273,112 12/1993 Schultz .
5,273,113 12/1993 Schultz .
5,279,363 1/1994 Schultz et al. .
5,318,130 6/1994 Manke .
5,332,035 7/1994 Schultz et al. .
5,332,048 7/1994 Underwood et al. .
5,343,963 9/1994 Bouldin et al. .
5,358,035 10/1994 Grudzinski .
5,427,133 1/1995 Pringle .
5,455,573 10/1995 Delatorre .
5,457,988 10/1995 Delatorre .
5,465,786 11/1995 Akkerman .
5,483,988 1/1996 Pringle .
5,535,767 7/1996 Schnatzmeyer et al. .
5,535,828 7/1996 der Kinderen et al. .
5,597,042 1/1997 Tubel et al. .
5,634,522 6/1997 Hershberger .
5,662,165 9/1997 Tubel et al. ..... 166/65.1 X
5,706,892 1/1998 Aeschbacher et al. ..... 166/66
5,706,896 1/1998 Tubel et al. ..... 166/52
5,730,219 3/1998 Tubel et al. ..... 166/65.1 X
5,732,776 3/1998 Tubel et al. ..... 166/65.1 X
5,803,167 9/1998 Bussear et al. ..... 166/65.1

COMPUTER CONTROLLED GAS LIFT SYSTEM

CROSS-REFERENCE TO RELATED APPLICATION

This is a divisional of U.S. Ser. No. 08/812,467, filed Mar. 6, 1997, now U.S. Pat. No. 5,896,924, which is a continuation in part of U.S. Ser. No. 08/599,324, filed Feb. 9, 1996, now U.S. Pat. No. 5,706,892 which in turn is a continuation-in-part of U.S. Ser. No. 08/386,505, filed Feb. 9, 1995, (now abandoned).

BACKGROUND OF THE INVENTION

1. Field of the Invention

The invention relates to well production control systems, and more particularly, to a computer controlled gas lift system.

2. Prior Art

In the operation of hydrocarbon production wells, gas lift apparati are occasionally employed to stimulate movement of fluid uphole. The operation ranges from simply pumping high pressure gas downhole to force fluids uphole to pumping additional fluids into the production fluid lowering the specific gravity thereof and thus increasing the "interest" of the fluid in migrating toward the surface. Gas lift apparati are also periodically employed when, a mixture of oil and water collects in the bottom of a gas well casing and tubing in the region of the producing formation and obstructs the flow of gases to the surface. In a "gas lift" well completion, high pressure gas from an external source is injected into the well in order to lift the borehole fluids collected in the well tubing to the surface to "clear" the well and allow the free flow of production fluids to the surface. This injection of gas into the well requires the operation of a valve controlling that injection gas flow known as a gas lift valve. Gas lift valves are conventionally normally closed restricting the flow of injection gas from the casing into the tubing and are opened to allow the flow of injection gas in response to either a preselected pressure condition or control from the surface. Generally such surface controlled valves are hydraulically operated. By controlling the flow of a hydraulic fluid from the surface, a poppet valve is actuated to control the flow of fluid into the gas lift valve. The valve is moved from a closed to an open position for as long as necessary to effect the flow of the lift gas. Such valves are also position instable. That is, upon interruption of the hydraulic control pressure, the gas lift valve returns to its normally closed configuration.

A difficulty inherent in the use of single gas lift valves which are either full open or closed is that gas lift production completions are a closed fluid system which are highly elastic in nature due to the compressibility of the fluids and the frequently great depth of the wells.

Prior art flow control valves for downhole applications, such as single gas lift valves per area, include the disadvantage of not providing a substantial amount of control over the exact amount of gas entering the well. This is because the valve is either open or closed and cannot be regulated. Hydraulically actuated downhole flow control valves also include certain inherent disadvantages as a result of their long hydraulic control lines which result in a delay in the application of control signals to a downhole device. In addition, the use of hydraulic fluids to control valves will not allow transmission of telemetry data from downhole monitors to controls at the surface.

Boyle et al patented a system capable of adjusting the orifice size of the valve through a range of values, thus providing a broader control over the amount of gas being injected into the system. U.S. Pat. No. 5,172,717 to Boyle et al discloses a variable orifice valve for gas lift systems. The system allows for adjustment of the flow through a particular valve body thereby allowing tailoring of the flow rate and alleviation of some of the previous problems in the art. The variable orifice valve allows greater control over the quantity and rate of injection of fluids into the well. In particular, more precise control over the flow of injection gas into a dual lift gas lift well completion allows continuous control of the injection pressure into both strings of tubing from a common annulus. This permits control of production pressures and flow rates within the well and results in more efficient production from the well.

The '717 patent solved many of the aforementioned problems with its variable orifice valve. Variable opening however provides some of its own inherent drawbacks such as lack of reliability of "openness" over time. More particularly, scale and other debris can build up and prevent movement more easily on orifice closures which are responsive to small increment movements and, in general, are only moved or adjusted by such small increments. Thus when conditions change downhole over time the variable orifice valve may be unable to comply with the changing conditions and would need to be replaced.

Another adjustable gas lift valve is disclosed in U.S. Pat. No. 5,483,988. The disclosure teaches a system having several parts or features but particularly includes an adjustable flow gas lift valve which includes a flow port and a plurality of differently sized nozzles selectively alignable with the port. Sensory devices are employed to maintain information about the state of the valve assembly. The variable nozzles are located on the actuator and, therefore, can be rotated into alignment with the orifice port to regulate the amount of gas flowing therethrough as desired.

Fully open/fully closed valves provide a large relative movement and tend to jar loose any buildup so that valve serviceability is maintained for a longer period of time. Therefore, these valves have a significant service life advantage over the more "advanced" variable opening valves. Also, where a plurality of these valves are employed in a given area, the closing of some (or opening) does not subject the individual valves to the same torsional forces because all flow is not pitted against a single structure. Thus opening or closing of the valves does not lead to excessive wear of valve components. The industry is in need of a system that experiences the benefit of variable orifice valves while concurrently benefitting from the serviceability of fully open/fully closed valves.

SUMMARY OF THE INVENTION

The above-discussed and other drawbacks and deficiencies of the prior art are overcome or alleviated by the adjustable flow gas lift valve of the invention.

In accordance with the invention, computer control and sensory information are combined with a series per unit area of fully open/fully closed gas lift valves to provide for intelligent downhole gas lift systems. Several embodiments of valve systems are set forth herein which provide adjustable control of the amount of gas injected into the tubing string and are responsive to downhole sensory data, processing and instructions.

In the first embodiment, a housing encloses an electrical motor which is paired with a resolver attached to a ball screw which is used to move a ported sleeve into various positions within the housing. Ports are present on the sleeve and at least one opening is employed on the housing of the tool. Thus, by aligning different numbers of ports in the sleeve with the main annulus opening, the amount of gas entering the tubing string is adjustable and controllable.

A second embodiment of the invention employs the elements of the first embodiment, however, also employs a multiported housing (as opposed to the single annulus opening of the first embodiment) having variously sized ports to provide even greater adjustability of the amount of flow of gas into the tubing string. In other respects, the embodiment operates as does the first embodiment.

The third embodiment of the invention employs an electric motor attached to a high pressure hydraulic pump. The pump discharges into an expandable bladder which is disposed adjacent several holes or slots in the housing, which slots lead to the casing annulus. As pressure increases in a chamber defined by the bladder, more of the holes or slots, or a larger percentage of the holes and slots, are blocked by the expanded bladder. By decreasing the pressure within the bladder the bladder will shrink and allow pressure from the annulus to move through the slots or holes.

In the fourth embodiment of the invention, fluid movement from the annulus to the tubing is electrically controlled by a motor operating a piston moving within a cylinder having ports to the annulus. Each port includes a seat and a check ball to seal the port, the check ball being displaceable (unseatable) by the movement of the piston within the cylinder. More specifically, as the piston moves along the cylinder it will contact an increasing number of check balls and unseat them from their respective seats thus allowing a proportionate amount of fluid from the annulus to flow into the tubing. This embodiment also includes a matching seat machined to compliment the piston such that if the valve is to be completely sealed, the piston may be moved into contact with the matching seat thus preventing all flow.

A fifth embodiment of the invention employs at least a plurality of commercially available, conventional fully open/fully closed valves per unit area This arrangement allows for control of the amount of fluid passing into the production fluid in a given area by allowing the operator to selectively open one or more of the plurality of valves located either annularly at a point in the tubing or staggered but closely to the same point. In other words there are clusters of nozzles where a single nozzle would have been in the prior art. It will be understood that the term operator is intended to mean an actual human or a computer processor either downhole or at the surface. The system allows incremental increase in flow rate.

A sixth embodiment is a variation on the fifth embodiment in that the basic premise of employing at least a plurality of individually fully operable/fully closeable valves is retained, however, each of the valves in this embodiment are of different sizes so that single valves or combinations thereof may be opened and closed to provide more control over the amount of fluid moving into the production tubing.

A seventh embodiment provides a helical valve body which rotatably opens or closes a helical flow path.

An eighth embodiment provides a flow control system in a side pocket mandrel to allow communication between the primary wellbore and the well annulus.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

Figure 1:
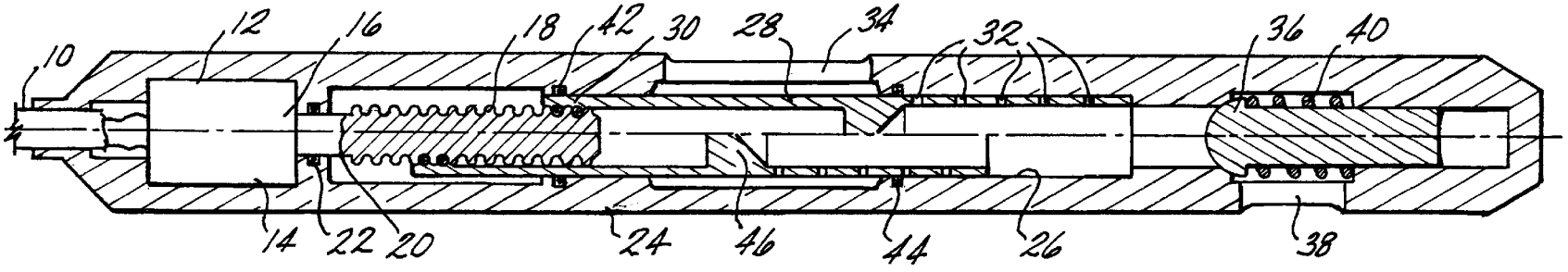
FIG. 1 is a sectional illustration of a first embodiment of the invention.

Referring to FIG. 1, a schematic illustration of the first embodiment of the invention is illustrated in cross-section. It will be understood by one of ordinary skill in the art that the entire device is intended to be attached to the outside of the tubing string and has relatively small dimensions. The invention is powered by electric line 10 connected to an electric motor 12 (and controlled by a downhole processor) having a resolver 14. The motor turns ball screw 18 through gear box 16 which provides axial movement of the sleeve discussed hereunder. Shaft 20 of ball screw 18 is preferably isolated from motor 12 by o-ring 22 which is mounted in housing 24. Housing 24 defines sleeve chamber 26 within which ported sleeve 28 is axially movable. A top section of sleeve 28, indicated as box thread 30 includes a pitch complimentary to ball screw 18 and is threaded thereon. Therefore, upon rotational actuation of ball screw 18, ported sleeve 28 is axially movable within chamber 16 of housing 24. Upon such movement of ported sleeve 28 individual ports 32 thereof are selectively alignable with main annulus opening 34, thus allowing fluid to flow from the annulus into chamber 26. Fluid pressure inside chamber 26 will unseat check valve 36 and flow therepast through tubing access opening 38 and into its desired destination of the production string (not shown). One of skill in the art will appreciate that check valve 36 is energized by spring 40 to maintain it in the closed position. This prevents fluid flowing within the tubing accessed by tubing access opening 38 from contaminating the gas lift valve or the annulus.

In the interest of maintaining the electric motor and the ball screw free from production fluid and other debris chamber 26 includes o-rings 42 and 44 which seal against ported sleeve 28.

Figure 2:
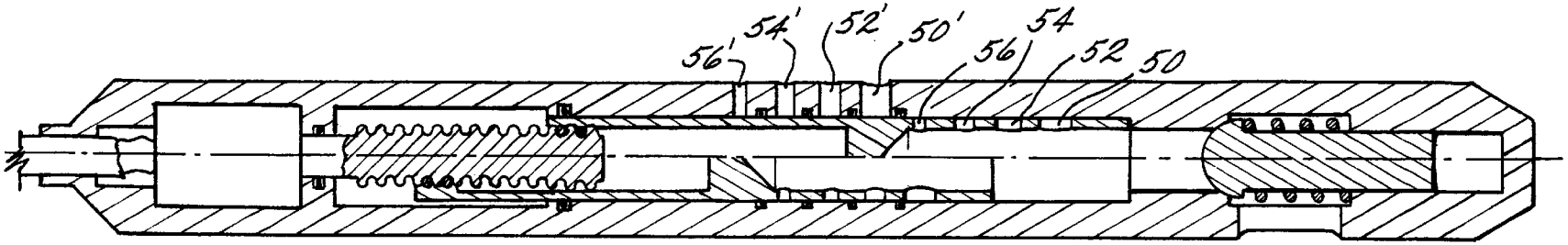
FIG. 2 is a sectional view of a second embodiment of the invention.

Ported sleeve 28 is most preferably constructed from solid rod in which thread 30 is cut and an axial opening is drilled partially into the rod providing through passage for the ports 32. The solid portion of the rod left after machining is body seal 46. One of skill in the art will appreciate that in FIG. 1 the ported sleeve has been separated along the center line of the drawing to illustrate sleeve 28 in two positions i.e., partially activated and closed off. One of ordinary skill in the art will appreciate that in actuality body seal 46 is contiguous with the mirror (but moved over) image thereof on the other side of the drawing. In the second embodiment of the invention, referring to FIG. 2, only the major differences from the embodiment of FIG. 1 will be described. It should be noted that the embodiment of FIG. 2 provides even more control over the amount of flow of gas from the annulus to the production tubing string by providing individual ports on the ported sleeve of differing sizes and by employing a series of differently dimensioned ports through the housing to the annulus instead of employing a single annulus opening. Thus, by aligning desired ports of the ported sleeve with desired ports in the annulus opening a large degree of control is provided regarding the amount of gas (or other fluid) from the annulus which will pass through to the tubing string. Referring to FIG. 2, individual ports are identified by individual numerals due to their different sizes and to more clearly illustrate that fact. Port 50 is the largest port, ports 52, 54 and 56 become progressively smaller. Each of these ports are complimentary in size to ports 50', 52', 54' and 56' of the housing. Selective alignment among the ported sleeve ports and housing ports provides control over flow rate. The sleeve ports are arranged to be alignable in such a way that a smaller inner port is always aligned with a larger outer port unless the tool is completely open. This is to reduce erosional problems in the tool due to high flow rates through the valve. The inner sleeve is constructed from a higher resistance material and is therefore in a better position to handle the high flow.

Figure 3:
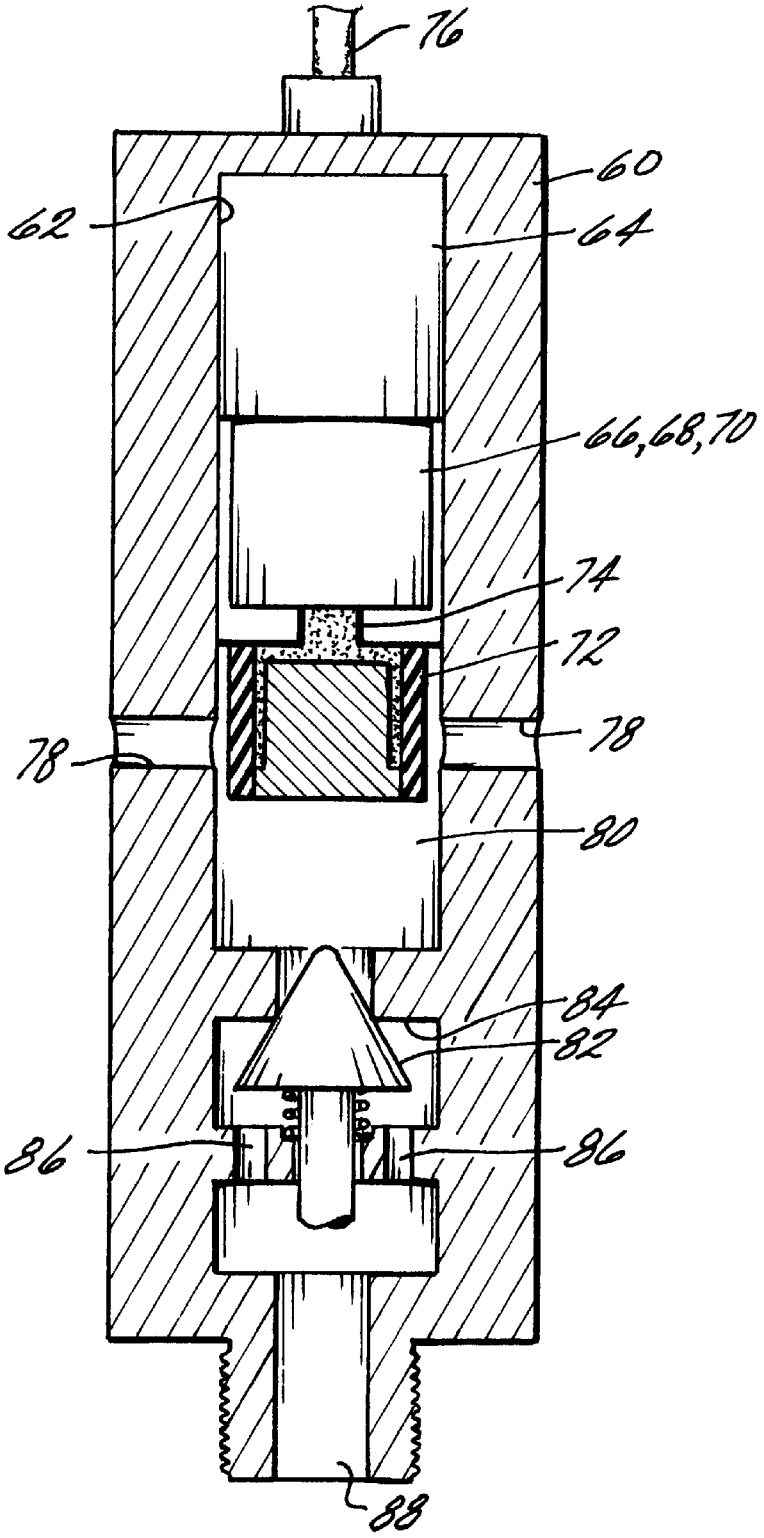
FIG. 3 is a sectional view of a third embodiment of the invention.

Referring to FIG. 3, a third embodiment of the invention is illustrated in schematic form. Generally speaking, this embodiment depends upon an expandable bladder and a reservoir which is pressurizable to force fluid into the bladder thus expanding the same. Upon expanding the bladder, flow ports into the housing are blocked. When the flow ports are blocked, gas pressure from the annulus cannot reach the interior of the tubing. In particular, the invention includes a housing 60, interior chamber 62 wherein downhole electronics 64 are located and are attached to electric motor 66, pump 68 and reservoir 70. Bladder 72 is sealingly connected to the conduit 74 of the pump 68 such that upon command from downhole control line 76 to electronics 64 an electric motor 66 is actuated and turns pump 68, thus pumping fluid from reservoir 70 through conduit 74 into bladder 72, the bladder 72 expands in size and contacts the interior surface of chamber 62 thus blocking flow ports 78 which extend through housing 60. It will be understood that the more pressure in the bladder, the more force will be exerted against the ports and the less gas will flow. Flow ports 78 provide access to annulus gas pressure and extend to chamber 62. The ports 78 may be holes or slots as desired or as dictated by particular downhole conditions. Another part of chamber 62 is indicated as flow barrel 80 and it is this portion of the chamber which communicates between ports 78 and a reverse flow check valve 82 positioned within housing 60. The reverse flow check valve 82 is a commercially available part and does not require further discussion.

Upon deflation of bladder 72, ports 78 are opened and gas pressure from the annulus (not shown) will flow into flow barrel 80, push reverse flow check valve off seat 84 allowing the pressure of the gas to expand around the reverse flow check valve 82 and through flow ports 86 to the end of housing 60 where access opening 88 to the production tubing is provided.

It should be understood that the housing of the invention in embodiment 3 may be made up to the tubing or adapted in a wireline retrievable version to a side pocket mandrel.

In general, the pump of the invention may be merely a piston moving within a cylinder wherein as the piston extends toward the cylinder head the fluid is forced into the bladder end when the piston moves away from the cylinder head the bladder will, by elasticity, force the fluid back into the cylinder. It is not necessary for the pump to act as a conventional pump does in forcing more and more pressure since the movement of the bladder is not required to be substantial. Rather, the bladder need move only a small amount in order to seal off ports 78. The pump may simply move fluid out of the reservoir with extension of the piston and allow fluid into the reservoir with a retraction of the piston. It should also be understood that the pump may be of a conventional variety and will function equivalently to the simple pumping action just described.

Figure 4:
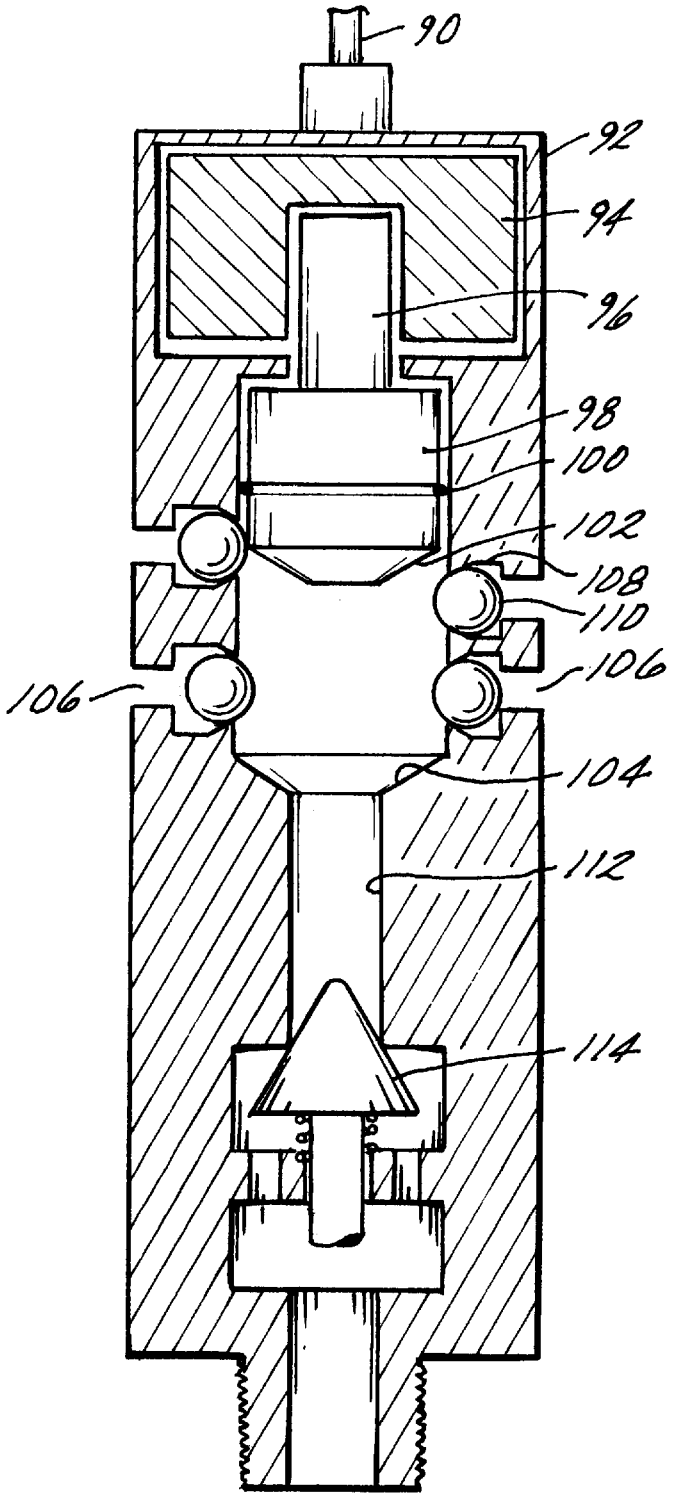
FIG. 4 is a sectional view of a fourth embodiment of the invention.

Referring to FIG. 4, a fourth embodiment of the invention is disclosed is schematic form which uses a similar housing to that of embodiment 3, however, provides an alternate seal method for the ports. In this embodiment, downhole control line 90 extends from the surface to housing 92 wherein electronics and motor 94 are disposed and connected via a connecting rod 96 to piston 98. In order to maintain the motor and electronics free of fluids, piston ring 100 is supplied around piston 98. It should be noted at this point that piston 98 has a crowned section 102 which is machined to be complimentary to a matching seat 104 such that, if desired, the piston may be extended until it is seated in the matching seat which prevents any movement of fluid therepast.

In operation the gas lift valve is adjustable due to a plurality of ports 106 having machined seats 108 and complimentary check balls 110 which seat therein and seal the port. The balls are seated in such a manner that they protrude into the path of piston 98 within flow tube/cylinder 112. Upon movement of piston 98, contact with the check balls 110 will unseat them from seats 108 thus allowing fluid from the annulus (not shown) to flow through ports 106 past check balls 110 and into a flow tube/cylinder 112. It will be understood by one of skill in the art that the number of size of ports and check balls is preadjustable as well as their orientation such that when the piston moves a certain amount a controlled amount of fluid is allowed into the system. The amount of flow through the valve can be accurately maintained. Once fluid from the annulus has reached the flow tube/cylinder 112 it presses past reverse flow check valve 114 in the same manner as the prior embodiment. Since in other respects this embodiment is identical to that of embodiment 3 no further discussion hereof is required.

Figure 6:
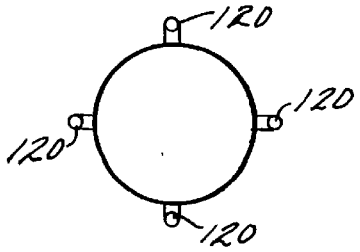
FIG. 6 is a schematic plan view of FIG. 5 taken along lines 6—6.
Figure 5:
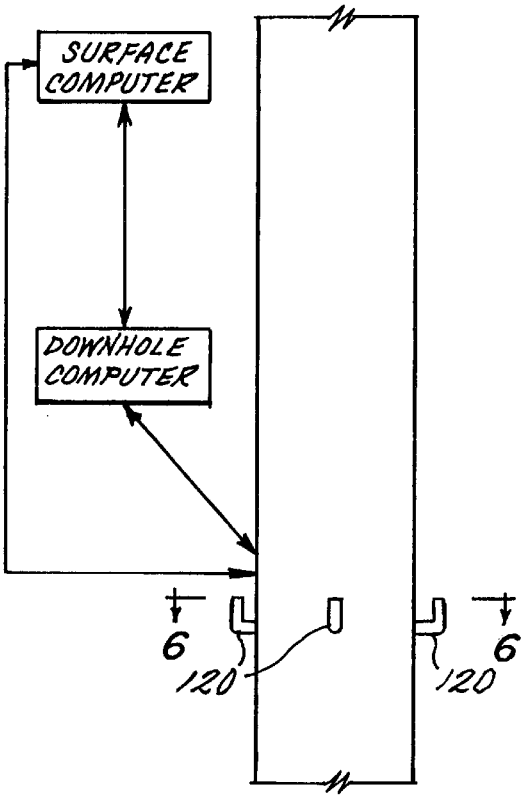
FIG. 5 is a schematic view of the fifth embodiment of the invention having a multiplicity of valves of like dimensions.

Turning now to FIGS. 5 and 6, another alternate embodiment of the invention is provided which allows for control over the amount of fluid provided to the production tubing. From this embodiment several conventional fully opened or fully closed valves 120 are actuatable at will either hydraulically or electrically from the surface or by downhole processor so the control over the amount of fluid entering the flow tube can be maintained. By opening 1, 2, 3 or 4 of the valves at any given time flow into the tube can be controlled to 25, 50, 75 or 100 percent of the allowable amount of gas. Since the valves are traditional on/off valves they are readily commercially available, easy to operate and provide a substantial service life.

Figure 8:
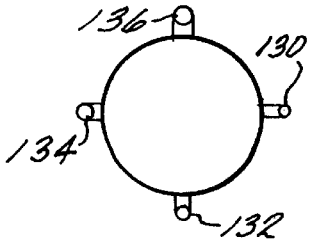
FIG. 8 is a schematic plan view of FIG. 7 taken along section line 8—8.
Figure 7:
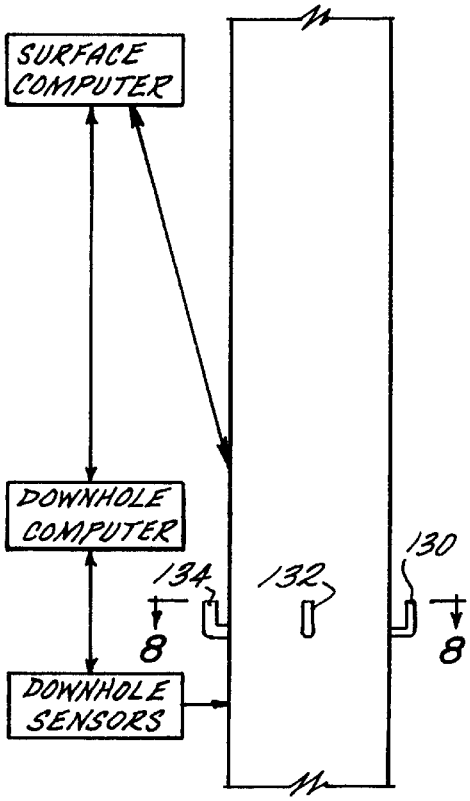
FIG. 7 is a schematic view of a sixth embodiment of the invention having a multiplicity of different sized valves.

Referring to FIGS. 7 and 8, one of ordinary skill in the art will appreciate that the general concept of the embodiments from FIGS. 5 and 6 is repeated, however, each of the fully opened/fully closed valves 130, 132, 134 and 136 are of different sizes thus providing even more control over the precise amount of fluid entering the tube. For example, and for purposes of argument, let valve 130 equal 10, valve 132 equal 20, valve 134 equal 30 and valve 136 equal 40 units per minute flow rate, then if valve 130 is opened alone ten units will flow, however, if valve 130 and 132 are opened together 30 units would flow whereas 132 opened alone would allow 20 units to flow, etc. It should be clear that any number of the valves can be opened together and all of them can be opened independently. This provides a great range of control over adjustability of the amount of fluid passing into the tube, yet, relies upon fully opened/fully closed valves which are easily commercially available and have been time tested by the industry.

Figure 9:
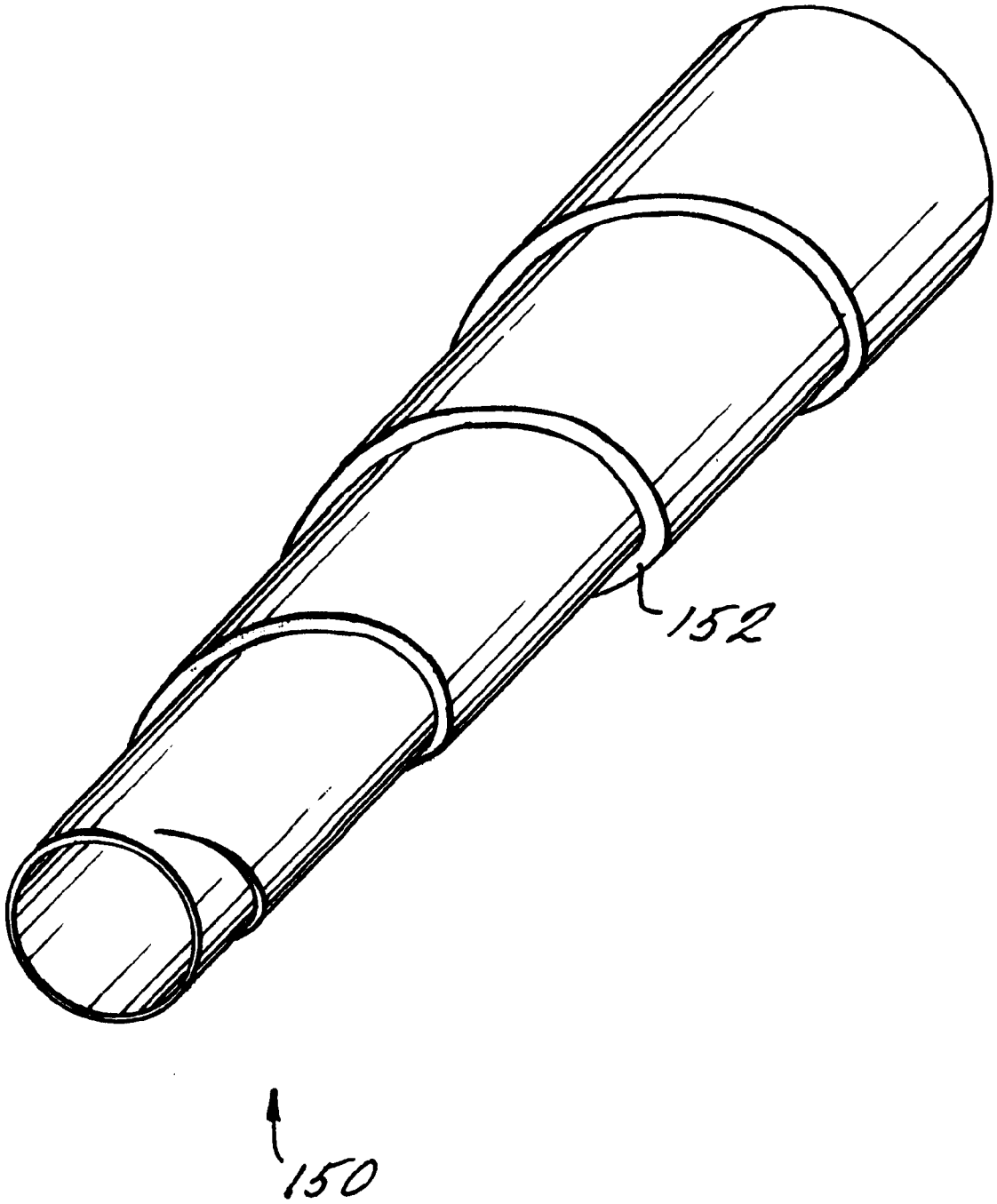
FIG. 9 is a perspective view of another embodiment of the invention employing a helical valve structure.
Figure 10:
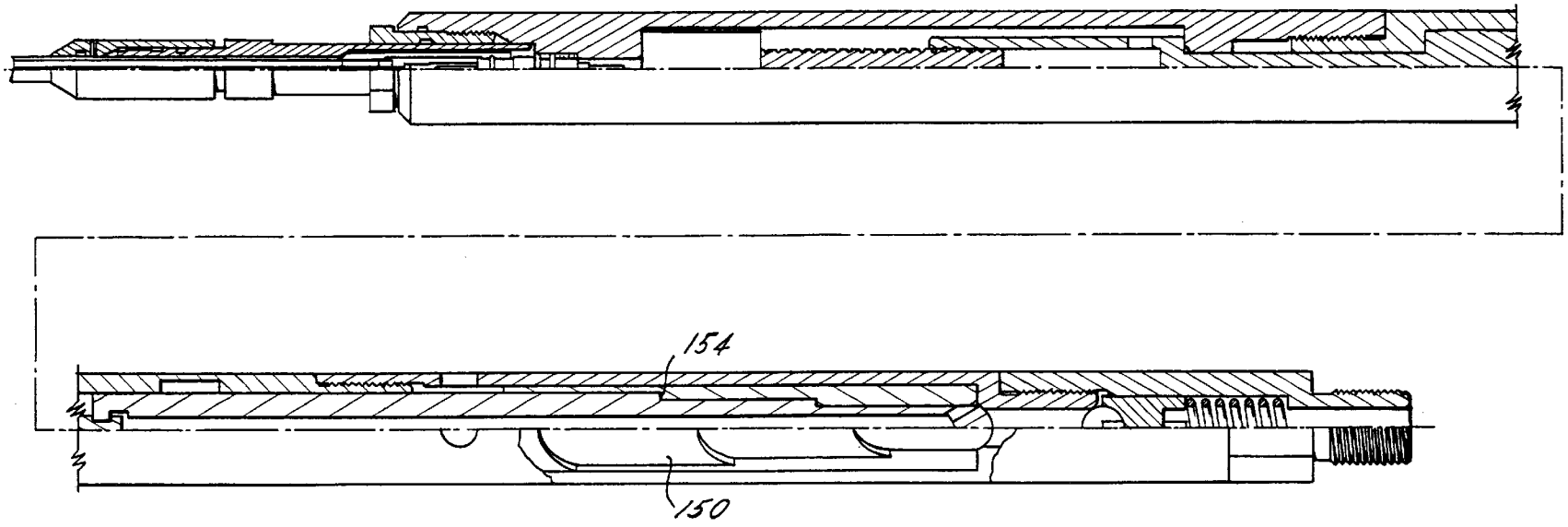
FIG. 10 is a cut away view of the body of the tool in which the valve structure of FIG. 9 is placed.

In yet another embodiment of the invention, a helical valve is employed to variable control the inflow of gas into the production tube. FIG. 9 illustrates a perspective view of the valve member itself is illustrated; FIG. 10 places the valve member in context with the rest of the tool.

Referring to FIG. 9, helical valve body 150 is illustrated to include seat face 152 which is in the most preferred embodiment a polished face. One of skill in the art will appreciate that face 152 is visible four times in the drawing but represents only one structure. In FIG. 10, valve body 150 is illustrated in conjunction with the rest of the tool. The tool is in quarter cut-away form to illustrate the mating surface 154 against which face 152 abuts when the valve is closed. Upon moving(rotating) body 152 the distance between mating surface 154 and face 152 is varied. A larger distance translates to an increased flow rate and a smaller distance indicates a restricted flow. As one of skill in the art will appreciate, fluid flowing through the valve of the invention follows a helical path between surface 154 and face 152.

The tool of FIGS. 9 and 10 is actuated either longitudinally or rotationally by any conventional downhole movement device such as a hydraulic or electric downhole piston or motor assembly, a magnetic propulsion device, a racheting device, etc.

The valve flow path through the space created between surface 154 and face 152 can be either a constant one or one of varying dimension depending on how the helical structure is defined. For example, the amount of space in the flow path can be X at the larger end of the valve body and X+N at the narrower end of the valve body or that space may remain substantially constant along the path. In general, as one of skill in the art will appreciate, the flow path in this valve system will be of a generally rectangular cross section.

In order to automate the valve system of the invention sensors are installed at the interfacing sections of the valve structure so that both flow and openness of the valve can be measured. The valve of the invention is also preferably associated with a sensor or sensor array capable of providing information about the fluid pressure below the valve and that above the valve to allow a downhole processor, or even an uphole processor to monitor the "health" of the valve. Communication capability is also provided to allow the tool to send information to and receive instructions from the processor or from other tools.

Figure 11:
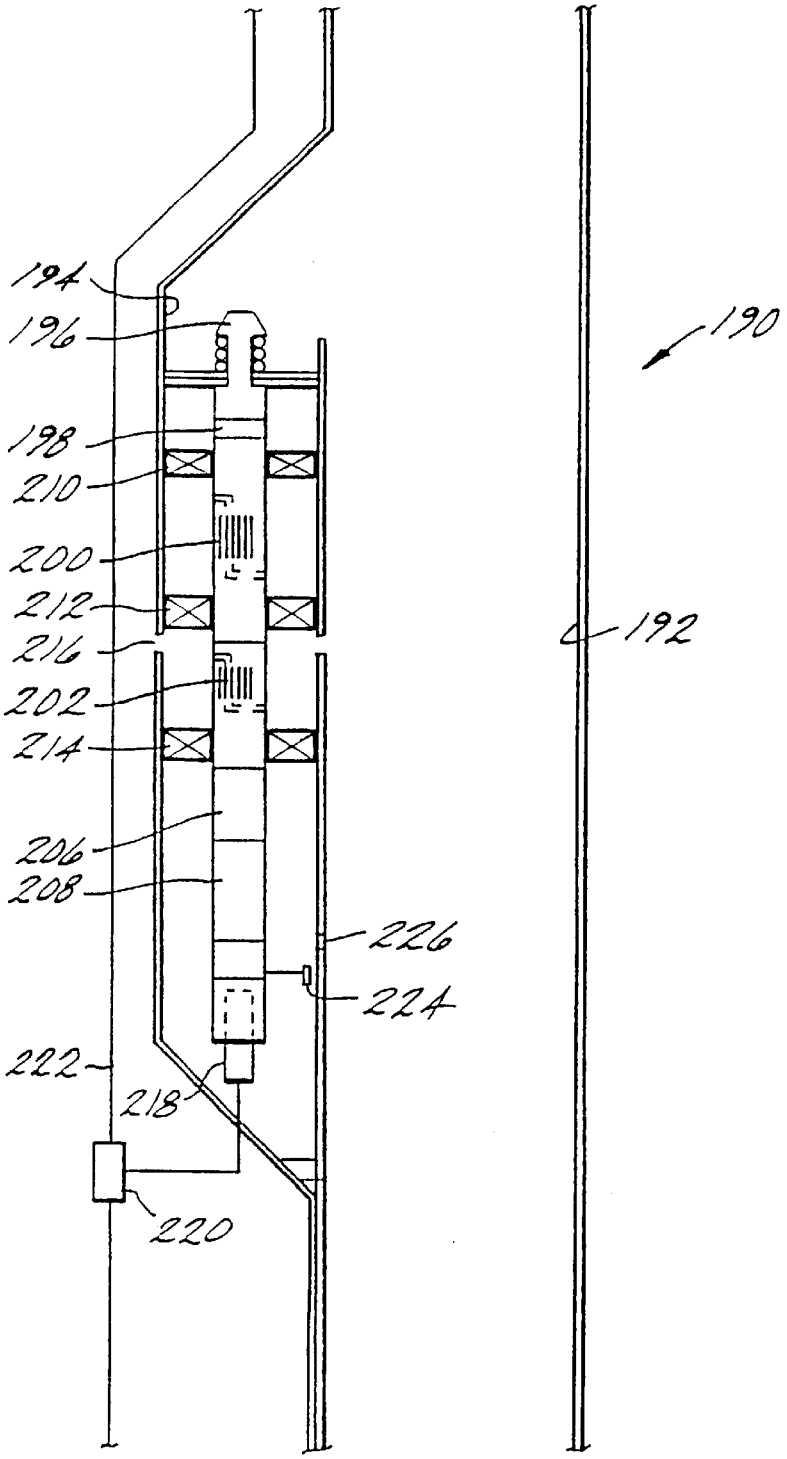
FIG. 11 is a schematic view of the side pocket mandrel embodiment of the invention.

Referring now to FIG. 11, a remotely controlled fluid/gas control system is shown and includes a side pocket mandrel 190 having a primary bore 192 and a side bore 194. Located within side bore 194 is a removable flow control assembly in accordance with the present invention. This flow control assembly includes a locking device 196 which is attached to a telescopic section 198 followed by a gas regulator section 200, a fluid regulator section 202, a gear section 204 and motor 206. Associate with motor 206 is an electronics control module 208. Three spaced seal sections 210, 212 and 214 retain the flow control assembly within the side bore or side pocket 194. Upon actuation by electronics module 208, control signals are sent to motor 206 which in turn actuates gears 204 and moves gas regulator section 200 and fluid regulator section 202 in a linear manner upwardly or downwardly or in a rotary manner within the side pocket 194. This movement (linear in the drawing) will position either the gas regulator section 200 or the fluid regulator section 202 on either side of an inlet port 216.

Preferably, electronics control module 208 is powered and/or data signals are sent thereto via an inductive coupler 218 which is connected via a suitable electrical pressure fitting 220 to the TEC cable 192 of the type discussed above. A pressure transducer 224 senses pressure in the side pocket 194 and communicates the sensed pressure to the electronics control module 208 (which is analogous to downhole module 22 as set forth in U.S. Ser. No. 08/599,324 previously incorporated herein by reference). A pressure relief port is provided to side pocket 194 in the area surrounding electronics module 208.

The flow control assembly shown in FIG. 11 provides for regulation of liquid and/or gas flow from the wellbore to the tubing/casing annulus or vice versa. Flow control is exercised by separate fluid and gas flow regulator subsystems within the device. Encoded data/control signals are supplied either externally from the surface or subsurface via a data control path 222 and/or internally via the interaction of the pressure sensors 224 (which are located either upstream or downstream in the tubing conduit and in the annulus) and/or other appropriate sensors together with the on-board microprocessor 208 in a manner discussed above with regard to FIGS. 6 and 7 of U.S. Ser. No. 08/599,324 previously incorporated herein by reference.

The flow control assembly of this invention provides for two unique and distinct subsystems, a respective fluid and gas flow stream regulation. These subsystems are pressure/fluid isolated and are contained with the flow control assembly. Each of the systems is constructed for the specific respective requirements of flow control and resistance to damage, both of which are uniquely different to the two control mediums. Axial reciprocation of the two subsystems, by means of the motor 206 and gear assembly 204 as well as the telescopic section 198 permits positioning of the appropriate fluid or gas flow subsystem in conjunction with the single fluid/gas passages into and out of the side pocket mandrel 190 which serves as the mounting/control platform for the valve system downhole. Both the fluid and gas flow subsystems allow for fixed or adjustable flow rate mechanisms.

The external sensing and control signal inputs are supplied in a preferred embodiment via the encapsulated, insulated single or multiconductor wire 222 which is electrically connected to the inductive coupler system 218 (or alternatively to a mechanical, capacitive or optical connector), the two halves of which are mounted in the lower portion of the side pocket 194 of mandrel 190, and the lower portion of a regulating valve assembly respectively. Internal inputs are supplied from the side pocket 194 and/or the flow control assembly. All signal inputs (both external and internal) are supplied to the on-board computerized controller 208 for all processing and distributive control. In addition to processing of offboard inputs, an ability for on-board storage and manipulation of encoded electronic operational "models"

constitutes one application of the present invention providing for autonomous optimization of many parameters, including supply gas utilization, fluid production, annulus to tubing flow and the like.

The remotely controlled fluid/gas control system of this invention eliminates known prior art designs for gas lift valves which forces fluid flow through gas regulator systems. This results in prolonged life and eliminates premature failure due to fluid flow off the gas regulation system. Still another feature of this invention is the ability to provide separately adjustable flow rate control of both gas and liquid in the single valve. Also, remote actuation, control and/or adjustment of downhole flow regulator is provided by this invention. Still another feature of this invention is the selected implementation of two devices within one side pocket mandrel by axial manipulation/displacement as described above. Still another feature of this invention is the use of a motor driven, inductively coupled device in a side pocket. The device of this invention reduces total quantity of circulating devices in a gas lift well by prolonging circulating mechanism life. As mentioned, an important feature of this invention is the use of a microprocessor 208 in conjunction with a downhole gas lift/regulation device as well as the use of a microprocessor in conjunction with a downhole liquid flow control device.

All of the gas lift valves discussed herein are controllable by conventional means, however, it is highly desirable and preferable for the invention to have each of the valves controlled downhole by providing a series of sensors downhole to determine a plurality of parameters including exactly what fluid flow rate is required to be to correct whatever deviation the production tube is experiencing from optimal. These downhole sensors are most preferably connected to a downhole processing unit so that decisions may be made entirely downhole without the intervention of surface personnel. This is not to say that surface personnel are incapable of intervening in downhole operations since the downhole processor of the invention would certainly be connected to the surface via any known communication system which would allow information to be transferred to the surface and instructions transferred downhole if desired. In the absence of those instructions the gas lift valves of the invention would preferably set themselves based upon sensor input (see FIGS. 6 and 7 for schematic diagrams of the computer/sensor system employable with any of the embodiments of this invention). This is also most preferably connected to a complex communication and instruction system among different wells and remote areas alike. Further discussion of intelligent downhole tools may be found in Application Ser. No. 08/599,324 filed Feb. 9, 1996, which is a continuation-in-part of Application Ser. No. 08/386,505 filed Feb. 9, 1995, now abandoned, the entire contents of each of which are incorporated herein by reference.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A remotely controlled fluid/gas control system comprising:

a side pocket mandrel having a primary bore and a laterally offset side pocket;

an inlet port allowing said side pocket to communicate between said primary bore and the exterior of said side pocket mandrel;

a fluid/gas control system in said side pocket, said fluid/gas control system including;

a motor;

an extendable shaft extending from said motor and linearly movable within said side pocket;

a gas regulator connected to said shaft;

a fluid regulator connected to said shaft and spaced from said gas regulator;

seals separating said gas and fluid regulators;

an electronic controller in communication with said motor for actuating said motor and moving said shaft linearly to sequential positions wherein said gas regulator communicates with said inlet port and said fluid regulator communicates with said inlet port.

2. A liquid/gas control system comprising:

a) a side pocket mandrel having a primary bore and a laterally offset side pocket;

b) an inlet port allowing said side pocket to provide communication between said primary bore and an area exterior to said side pocket mandrel;

c) a liquid/gas control system disposed in said side pocket said control system including;

1) a motor;

2) a shaft operably connected to said motor, said shaft being movable between two discrete positions to facilitate said communication of a selected fluid phase between said bore and said area.

3. A liquid/gas control system as claimed in claim 2 wherein said shaft further includes a gas regulator.

4. A liquid/gas control system as claimed in claim 2 wherein said shaft further includes a liquid regulator.

5. A liquid/gas control system as claimed in claim 2 wherein said shaft further includes in spaced relation to each other a gas regulator and a liquid regulator.

6. A liquid/gas control system as claimed in claim 5 wherein said shaft includes at least one seal separating said gas and liquid regulators.

7. A liquid/gas control system as claimed in claim 2 wherein said system further includes an electronic controller in communication with said motor or actuating said motor and moving said shaft linearly to sequential positions wherein said gas regulator communicates with said inlet port and said fluid regulator communicates with said inlet port.

8. A liquid/gas control system as claimed in claim 7 wherein said controller is located downhole.

9. A liquid/gas control system as claimed in claim 7 wherein said controller is at a surface location.

* * * * *